US006599469B2

(12) United States Patent
Ishida et al.

(10) Patent No.: US 6,599,469 B2
(45) Date of Patent: Jul. 29, 2003

(54) NON-HEAT TREATED STEEL FOR SOFT NITRIDING

(75) Inventors: Kazuhisa Ishida, Nagoya (JP); Koichiro Inoue, Nagoya (JP)

(73) Assignee: Daido Steel Co., Ltd., Nagoya (JP)

( * ) Notice: Subject to any disclaimer, the term of this patent is extended or adjusted under 35 U.S.C. 154(b) by 0 days.

(21) Appl. No.: 10/057,941

(22) Filed: Jan. 29, 2002

(65) Prior Publication Data

US 2002/0139451 A1 Oct. 3, 2002

(30) Foreign Application Priority Data

Feb. 1, 2001 (JP) ..... 2001-025076

(51) Int. Cl.[7] ..... C22C 38/60; C22C 38/02; C22C 38/04

(52) U.S. Cl. ..... 420/87; 420/84; 420/126; 420/128; 148/320

(58) Field of Search ..... 420/87, 89, 126, 420/128; 148/320

(56) References Cited

U.S. PATENT DOCUMENTS 5,985,051 A * 11/1999 Yamamoto et al. ..... 148/320

FOREIGN PATENT DOCUMENTS

JP 404350113 A * 12/1992 ..... C21C/7/06

* cited by examiner

*Primary Examiner*—Deborah Yee
(74) *Attorney, Agent, or Firm*—Varndell & Varndell, PLLC

(57) ABSTRACT

Disclosed is a non-heat treated steel for soft niriding, which can provide forged parts exhibiting equal to or larger than the limit strain at which cracks occur in straightening by bending and equal to or larger than the fatigue strength when compared with the parts of conventional heat treated steel, such as S48C. The non-heat treated steel for soft nitriding consists essentially of, by weight, C: 0.2–0.6%, Si: 0.05–1.0%, Mn: 0.25–1.0%, S: 0.03–0.2%, Cr: up to 0.2%, sol-Al: up to 0.045%, Ti: 0.002–0.01%, N: 0.005–0.025%, and O: 0.001–0.005%; provided that the conditions, $$0.12[Ti\%]<[O\%]<2.5[Ti\%] \text{ and } 0.04[N\%]<[O\%]<0.75[N\%],$$

are met; the balance being Fe and inevitable impurities; and the structure after hot forging being a mixed structure of ferrite and pearlite.

2 Claims, 1 Drawing Sheet

NON-HEAT TREATED STEEL FOR SOFT NITRIDING

BACKGROUND OF THE INVENTION

The present invention concerns a non-heat treated steel for soft nitriding, especially, the non-heat treated steel for soft nitriding having good fatigue strength and good straightening ability by bending. The steel is a useful material for manufacturing machine parts. The term "non-heat treated steel" here means a steel for which normalization after hot forging is not necessary.

Machine parts such as gears, shafts, crankshafts and connecting rods have been manufactured with a carbon steel for machine structure (JIS S48 steel) by hot forging, normalizing and machining followed by soft-nitriding for the purpose of improving anti-seizure property, abrasion resistance and fatigue strength, and finally, finishing processing. Long materials as well as crankshafts, for which even slight bend is a problem, are subjected to straightening by bending.

In the conventional process, as noted above, normalizing is carried out after hot forging in order to regulate hardness, to make the crystal structure coarsened during the hot forging fine and uniform, and to improve soft-nitridability and straightening ability by bending. From the view to save costs and energy, however, there has been demand for non-heat treated steel for soft-nitriding.

Forged parts manufactured with such a non-heat treated steel by soft-nitriding is, as mentioned above, disclosed in Japanese Patent Disclosure No. 2000-8141. The non-heat treated steel comprises: by weight, C: 0.02–0.30%, Mn: 1.0–2.0%, P: up to 0.10%, Cr: 0–0.15%, s-Al: 0–0.01%, Ti: up to 0.02%, N: 0.010–0.030%, V: 0–0.02%, and optionally, one or more of S: 0.04–0.10%, Ca: 0.0003–0.0030% and Pb: 0.05–0.20%, the balance of Fe and inevitable impurities.

The non-heat treated steel for soft-nitriding to be material for the forged parts disclosed in the above Japanese Patent Disclosure contains a small amount of Ti in order to suppress austenite crystal growth during hot forging and to make the pearlite crystals occurring after cooling fine so as to minimize the initial cracks which may occur at the straightening by bending. The mechanism is that, even if cracks occur in pearlite crystals, propagation of the cracks is prevented by ferrite crystals which are distributed throughout the structure. However, it is difficult to make the pearlitic crystals uniformly small, and if the cracks occur in large pearlitic crystals, propagation of the cracks is easy, and thus, allowance for the bend-rectification is small.

SUMMARY OF THE INVENTION

The object of the present invention is to provide such a non-heat treated steel for soft nitriding, for which normalization after forging can be eliminated, that the steel can be processed to the parts which exhibit allowance for straightening by bending and fatigue strength larger than those of parts made with JIS S48C steel by forging, normalizing and soft nitriding.

This object is achieved by the non-heat treated steel according to the present invention.

BRIEF EXPLANATION OF THE DRAWING

The attached single drawing shows the shape of a test piece for determining the fatigue strength, the hardness and the straightening-ability by bending, as well as the testing methods.

DETAILED EXPLANATION OF PREFERRED EMBODIMENTS OF THE INVENTION

Figure 1:
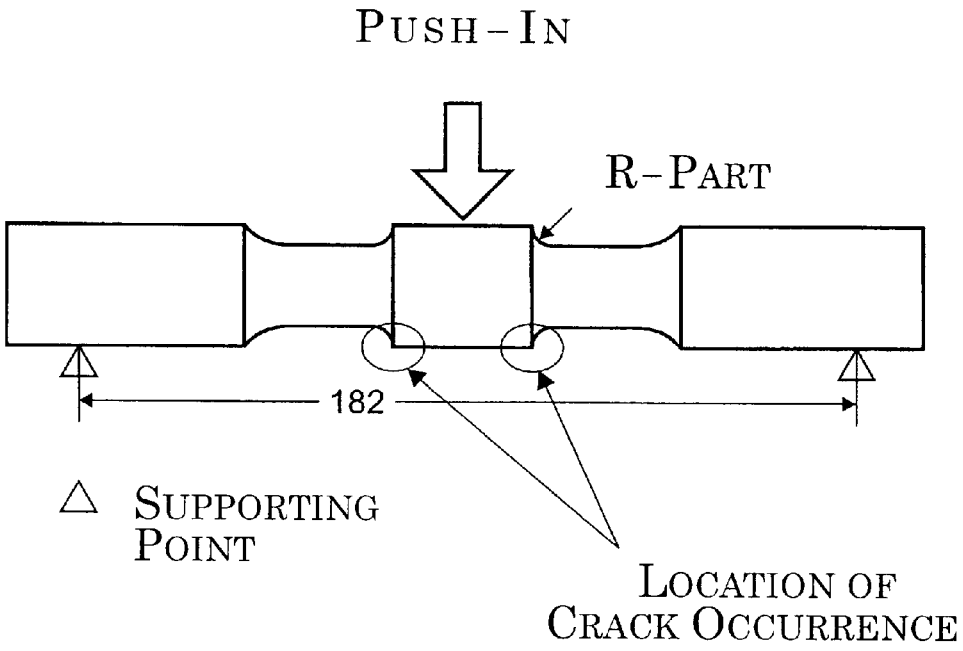

The non-heat treated steel for soft nitriding according to the present invention consists essentially of, as the basic alloy composition, by weight, C: 0.2–0.6%, Si: 0.05–1.0%, Mn: 0.25–1.0%, S: 0.03–0.2%, Cr: up to 0.2%, sol-Al: up to 0.045%, Ti:0.002–0.01%, N:0.005–0.025%, and O:0.001–0.005%; provided that the conditions $$0.12[Ti\%]<[O\%]<2.5[Ti\%] \text{ and } 0.04[N\%]<[O\%]<0.75[N\%]$$

are met; the balance being Fe and inevitable impurities; and the structure after hot forging being a mixed structure of ferrite and pearlite.

The non-heat treated steel for soft nitriding according to the present invention may contain, in addition to the above mentioned alloy components, one or more of Pb: 0.01–0.40%, Ca: 0.0005–0.0050% and Bi: 0.005–0.40%.

The inventors, for the purpose of solving the above noted problems, made research on the mechanism of occurring the cracks, both in the heat treated steel and non-heat treated steel for soft nitriding, and made efforts to provide non-heat treated steel for soft nitriding having uniform and small pearlite crystals. They discovered the following facts.

At the initial stage of straightening by bending, when the strain in the blank is small, cracks occur in the compound phase at the surface of the blank and the cracks proceed into units of pearlite crystals (hereinafter referred to as "pearlite block"). In the advanced stage, the cracks in the pearlite blocks take the role of the above mentioned initial cracks and proceed into the ferrite crystals and pearlite crystals at the inner parts of the blanks. Thus, the parts are destroyed to loose the function as the blanks.

It was further ascertained that the smaller the pearlite blocks neighboring to the compound phases are, the shorter the initial cracks are, and consequently, the more difficult for the initial cracks to propagate. Their conclusion is that, in order to improve the straightening-ability by bending, it is necessary to have the size of pearlite blocks minimized. They further knew that the non-heat treated steel is, after being soaked at a temperature above 1100° C., forged at a temperature above 950° C. and air cooled, and thus, the structure is a mixed structure of initially deposited ferrite which deposited along the prior austenite grain boundaries and the remaining pearlite crystals, while the heat treated steel has a mixed structure of fine ferrite crystals and fine pearlite crystals, due to the heat treatment carried out at a temperature around 800° C. followed by cooling, and thus, the austenite grains are kept fine.

The inventors further discovered that, because the prior austenite grains in the non-heat treated steel are generally coarser than those of the heat treated steel, and because the hardenability of the non-heat treated steel is thus higher than that of the heat treated steel, ferrite transformation is so suppressed in the non-heat treated steel that ferrite precipitation is difficult to occur. As the result, majority of the austenite tends to become pearlite, and size of the pearlite blocks of the non-heat treated steel are larger than that of the heat-treated steel, and the straightening-ability by bending is thus lowered.

It has been known that, in order to make the size of the pearlite blocks in the non-heat treated steel equal to that of the heat treated steel, it is necessary to promote ferrite precipitation in the prior austenite grains during cooling. For this purpose, it has been done to have MnS-inclusions distributed in the prior austenitic grains so that the inclusions may be the core for the ferrite precipitation. However, it is difficult to have the MnS-inclusions distributed uniformly in the steel, and thus the sizes of the pearlite blocks vary depending on the parts of the steel. The straightening-ability by bending will thus vary widely.

The inventors' further discovery is that, by choosing the contents of C, Mn, Cr, s-Al, Ti, N and O in the steel, it is possible to improve the strength, the facility to nitriding and the straightening-ability by bending of the steel. Particularly, remarkable discovery is that optimization of the O-content causes uniform distribution of fine MnS-inclusions in the steel, which promote ferrite precipitation from the prior austenite grains after hot forging and minimize scattering of the size of the pearlite blocks to improve the straightening-ability by bending. The present invention is based on this discovery.

The following describes the reasons for choosing the alloy composition of the present non-heat treated steel for nitriding as described above.

C: 0.2–0.6%

Carbon strengthens the steel, and is essential for the steel. To ensure the effect, it is necessary for the steel to contain at least 0.2%, preferably 0.3% or more of C. A content of 0.6% or more of C makes the steel too hard and the machinability of the steel will decrease. The content of C should thus be 0.2–0.6%, preferably, 0.3–0.5%.

Si: 0.05–1.0%

Silicon is used as a deoxidizing agent at steel-making, and increases strength of the steel by solid solution therein. These effects will be obtained at an Si-content of 0.05% or more, preferably, 0.15% or more. A higher content of 1.0% or more of Si makes the hardness of the steel too high, and lowers the machinability. The range of Si-content is thus set to 0.05–1.0%. A preferable content of Si is in the range of 0.15–0.5%.

Mn: 0.25–1.0%

Manganese is a necessary element from the view to enhance the fatigue strength of the steel and to form MnS-inclusions. Thus, at least 0.25%, preferably, 0.30% of Mn is added to the steel. On the other hand, Mn of 1.0% or more increases pearlite volume fraction and decreases straightening-ability by bending. The Mn-content is set to be in the range of 0.25–1.0%. Preferable range is 0.30–0.70%.

S: 0.03–0.2%

Sulfur is necessary for improving machinability of the steel. This effect is obtained at an S-content of 0.03% or higher, while a content of 0.2% or higher damages hot workability and fatigue limit of the steel. The S-content is thus decided to be 0.03–0.2%.

Cr: up to 0.2%

Chromium is generally contained in the steel as an impurity. Cr forms nitrides during the soft nitriding step and increases surface hardness and decrease straightening-ability by bending of the steel. Therefore, it is preferable that the Cr-content is as low as possible. Taking the costs for manufacturing the steel into account, 0.2% is allowable upper limit. The upper limit is preferably 0.1%, more preferably, 0.05%.

sol-Al: up to 0.045%

Soluble aluminum is an undesirable impurity, and it is desirable for the steel to contain no sol-Al. If a large amount of sol-Al is contained, Al deposits, like Cr, as the nitride, which extremely increase the surface hardness and decreases the straightening-ability by bending of the steel. Thus, the content of sol-Al should be up to 0.045%, preferably, up to 0.010%.

Ti: 0.002–0.01%

Titanium forms the nitride with nitrogen in the steel. The nitride, through the mechanims of suppressing prior austenite grain growth during hot forging, making the ferrite-pearlite structure fine, and minuting the size of pearlite blocks, improves the straightening-ability by bending of the steel. To obtain this effect, a Ti-content of 0.002% or more is essential, while a Ti-content exceeding 0.010% decreases the amount of nitrogen dissolved in the steel and results in decrease of the fatigue strength. Accordingly, the Ti-content in the steel is set to be in the range of 0.002–0.010%. Preferable range is 0.002–0.008%.

N: 0.005–0.025%

Nitrogen improves the fatigue strength of the steel and suppresses prior austenite grain growth during hot forging through the mechanism of forming nitride with Ti, which deposits finely in the steel. As the result, as explained in regard to Ti, the straightening-ability by bending will be improved. To obtain this effect it is necessary for the steel to contain N of 0.005% or more, preferably, 0.009% or more. At an N-content of 0.025% or more, the effect of N saturates, and thus, the N-content is chosen from the range of 0.005–0.025%. Preferable content is in the range of 0.009–0.024%.

O: 0.001–0.005%

Oxygen forms oxides with Ti, Al, Si and Ca in the steel. The oxides cause, by acting as the cores of MnS-precipitation, uniform distribution of fine MnS-inclusions in the steel. The MnS-inclusions also promote inner ferrite precipitation in the prior austenite grains during cooling after hot forging, and, by making the size of the pearlite blocks uniform and fine, improves the straightening-ability by bending. In order to obtain this effect an O-content of 0.001% or more, preferably, 0.0012% is necessary. Oxygen in an amount exceeding 0.005% forms the oxide with Ti, which suppresses formation of TiN and decreases the grain growth-suppressing effect at hot forging. For this reason, Ti-content is set to be 0.001–0.005%. Preferable range is 0.0012–0.0048%.

$$0.12[Ti\%]<[O\%]<2.5[Ti\%] \text{ and } 0.04[N\%]<[O\%]<0.75[N\%]$$

To balance the oxide and nitride of Ti at a suitable ratio it is necessary to satisfy these conditions. The reasons are as follows. In case where the amount of O is less than 0.12 [Ti%] and 0.04[N%], the amount of the oxide which forms the cores for MnS-precipitation is insufficient, and thus, uniform distribution of the fine MnS-inclusions will not be realized. On the other hand, in case where the amount of O is more than 2.5[Ti%] and 0.75[N%], too much oxide and too less nitride are formed, and thus, suppression of prior austenite grain growth during hot forging cannot be expected.

Pb: 0.01–0.40%, Ca: 0.0005–0.0050%, Bi: 0.005–0.40%

Lead, calcium and bismuth are added to the steel for the purpose of improving machinability of the steel. Such improvement will be obtained by addition of 0.01% or more of Pb, 0.0005% or more of Ca, or 0.005% or more of Bi. However, addition of Pb, Ca and Bi in the amounts exceeding 0.40%, 0.0050% and 0.40%, respectively, cause decrease in the hot workability and fatigue strength. The ranges of addition of these elements are thus decided. Other impurities, or P: up to 0.03%, Cu: up to 0.30%, Ni: up to 0.20% and Mo: up to 0.02%

Phosphor decreases impact strength of the steel, and therefore, the lower the P-content, the better. It is, however, expensive to lower the P-content to the extreme, the allowable upper limit is set to 0.03%, at which no substantial effect of P is observed. Copper, nickel and molybdenum are harmful to the straightening-ability by bending, and also, the lower their contents, the better. The contents, C: up to 30%, Ni: up to 0.20% and Mo: up to 0.02%, which may be inevitably come from melting materials are permissible.

An example of the process for producing the non-heat treated steel for soft nitriding according to the invention comprises: melting the materials in an arc furnace, adjusting the alloy composition in a ladle furnace, and, after regulating the oxygen content in a vacuum degassing apparatus, casting the molten steel into ingots. The ingots are then bloomed and hot rolled to slabs.

The non-heat treated steel for soft nitriding of the invention has, by choosing the contents of C, Mn, Cr, sol-Al, Ti, N and O, improved strength, nitridability and fatigue strength. Particularly, choice of the O-content at a suitable level suppresses prior austenite grain growth during hot forging and distribute fine MnS-inclusions uniformly in the steel, and then, the inclusions promote ferrite precipitation from the prior austenite grains after hot forging to minute the size of the pearlite blocks without scattering. The straightening-ability by bending is thus improved.

The present steel can provide forged parts exhibiting, even though the normalizing after forging is eliminated, equal to or larger than the limit strain at which cracks occur in straightening by bending and equal to or larger than the fatigue strength when compared with the parts of conventional heat treated steel, such as S48C, made by forging, normalizing and soft nitriding.

The uses of the present steel are, as noted above, machine parts subjected to soft nitriding such as gears, shafts, crankshafts and connecting rods, particularly, the steel is suitable for the long materials like shafts and crankshafts which are subjected to straightening by bending after soft nitriding.

EXAMPLES

The following examples are for detailed explanation of the invention.

Steels of the present invention or control steels having the alloy compositions shown in TABLE 1 were produced in an HF-induction furnace and cast by conventional way into ingots. The ingots were hot forged to billets of 70mm square section, and the billets were, after being soaked at 1200° C. for 60 minutes, further subjected to hot forging into steel rods of 40 mm square section, which were air-cooled. Test pieces were taken from these rods and the test pieces obtained were subjected to the following tests to determine fatigue strength, hardness, size of the pearlite blocks, uniformity of distribution of MnS-inclusions, straightening -ability by bending and machinability. Test results are shown in TABLE 2.

Fatigue Strength

The test for fatigue strength was done on the test pieces of the shape shown in FIG. 1, 210 mm long, and, after soft nitriding treatment in a salt bath (NaCN bath) at 580° C. for 5 hours, the test pieces were subjected to Ono-type rotary bending test.

Hardness

Test pieces for determining the hardness were taken from the test pieces for the fatigue strength tests by cutting out the test pieces from "R-part" shown in FIG. 1. The hardness was measured at the depth of 0.05 mm from the surface with a Vickers hardness tester (load 300 g).

Size of Pearlite Blocks

The size of the pearlite blocks was determined by the cutting method defined in JIS G 0552.

Distribution of MnS-inclusions

Distribution of MnS-inclusions was determined by observing 15 fields of view of 10 mm×16 mm at arbitrary parts of the hot forged blanks and evaluated by number density (particles/$mm^2$), dispersion of the number density (standard deviation) and the averaged length of the particles.

Straightening-Ability by Bending

The straightening-ability by bending was determined by preparing the test pieces of the shape shown in FIG. 1, 210 mm long, subjecting them to salt bath treatment for nitriding at 580° C. for 1.5 hours and three point-bending test of span 182 mm as shown in FIG. 1, and evaluating with the distance of push-in until crack occurs in the test pieces.

Machinability

Test pieces of diameter 90 mm were taken from the steel blanks and, after being heated to 100° C. and air-cooled, the machinability was determined by lathe-turning with cemented carbide tools. Conditions for the lathe-turning were as follows.

Cutting Speed: 200 mm/min

Feed: 0.2 mm/rotation

Depth of Cut: 2 mm

Critrion of tool life: duration until abrasion of cutting face reaches to 0.2 mm. Expressed by relative values taking Example 6 as the standard, 100.

TABLE 1

| No. | C | Si | Mn | S | Cr | s-Al | Ti | N | O | Pb, Ca, Bi | 0.12Ti | 2.5Ti | 0.04N | 0.7N |
|---|---|---|---|---|---|---|---|---|---|---|---|---|---|---|
| Invention | | | | | | | | | | | | | | |
| 1 | 0.21 | 0.08 | 0.55 | 0.030 | 0.08 | 0.003 | 0.0021 | 0.010 | 0.0034 | — | 0.0003 | 0.0053 | 0.0004 | 0.0070 |
| 2 | 0.47 | 0.22 | 0.30 | 0.048 | 0.06 | 0.003 | 0.0025 | 0.023 | 0.0028 | — | 0.0003 | 0.0063 | 0.0011 | 0.0196 |
| 3 | 0.55 | 0.91 | 0.87 | 0.065 | 0.02 | 0.003 | 0.0023 | 0.024 | 0.0020 | — | 0.0003 | 0.0056 | 0.0010 | 0.0168 |
| 4 | 0.40 | 0.19 | 0.53 | 0.045 | 0.05 | 0.001 | 0.0038 | 0.014 | 0.0035 | — | 0.0005 | 0.0095 | 0.0006 | 0.0098 |
| 5 | 0.39 | 0.26 | 0.50 | 0.045 | 0.06 | 0.003 | 0.0040 | 0.014 | 0.0048 | — | 0.0005 | 0.0100 | 0.0006 | 0.0098 |
| 6 | 0.39 | 0.25 | 0.52 | 0.041 | 0.06 | 0.003 | 0.0038 | 0.013 | 0.0013 | — | 0.0005 | 0.0095 | 0.0005 | 0.0091 |
| 7 | 0.35 | 0.21 | 0.48 | 0.043 | 0.12 | 0.003 | 0.0033 | 0.017 | 0.0028 | — | 0.0004 | 0.0083 | 0.0007 | 0.0119 |
| 8 | 0.40 | 0.26 | 0.52 | 0.045 | 0.06 | 0.003 | 0.0022 | 0.015 | 0.0012 | Pb0.15 Ca0.0014 | 0.0003 | 0.0055 | 0.0006 | 0.0105 |
| 9 | 0.41 | 0.22 | 0.53 | 0.046 | 0.06 | 0.002 | 0.0100 | 0.016 | 0.0048 | Pb0.07 Ca0.0018 | 0.0012 | 0.0250 | 0.0006 | 0.0112 |
| 10 | 0.43 | 0.20 | 0.30 | 0.046 | 0.06 | 0.043 | 0.0028 | 0.017 | 0.0036 | Bi0.12 | 0.0003 | 0.0007 | 0.0007 | 0.0119 |
| Controles | | | | | | | | | | | | | | |
| A | 0.10 | 0.18 | 0.55 | 0.045 | 0.05 | 0.002 | 0.0030 | 0.014 | 0.0030 | — | 0.0004 | 0.0075 | 0.0006 | 0.0098 |
| B | 0.62 | 0.18 | 0.56 | 0.045 | 0.08 | 0.002 | 0.0032 | 0.016 | 0.0032 | — | 0.0004 | 0.0080 | 0.0006 | 0.0112 |
| C | 0.39 | 0.20 | 1.08 | 0.045 | 0.06 | 0.001 | 0.0031 | 0.014 | 0.0030 | — | 0.0004 | 0.0078 | 0.0006 | 0.0098 |
| D | 0.39 | 0.18 | 0.54 | 0.047 | 0.20 | 0.002 | 0.0021 | 0.014 | 0.0032 | — | 0.0003 | 0.0053 | 0.0006 | 0.0098 |
| E | 0.40 | 0.19 | 0.55 | 0.048 | 0.09 | 0.042 | 0.0026 | 0.015 | 0.0029 | — | 0.0003 | 0.0065 | 0.0006 | 0.0105 |
| F | 0.39 | 0.18 | 0.54 | 0.047 | 0.08 | 0.002 | 0.0008 | 0.014 | 0.0032 | Pb0.17 Ca0.0018 | 0.0001 | 0.0020 | 0.0006 | 0.0098 |

TABLE 1-continued

| No. | C | Si | Mn | S | Cr | s-Al | Ti | N | O | Pb, Ca, Bi | 0.12Ti | 2.5Ti | 0.04N | 0.7N |
|---|---|---|---|---|---|---|---|---|---|---|---|---|---|---|
| G | 0.43 | 0.24 | 0.55 | 0.046 | 0.05 | 0.003 | 0.0006 | 0.016 | 0.0052 | — | 0.0001 | 0.0015 | 0.0006 | 0.0112 |
| H | 0.44 | 0.22 | 0.52 | 0.048 | 0.06 | 0.002 | 0.0008 | 0.015 | 0.0033 | — | 0.0001 | 0.0020 | 0.0006 | 0.0105 |
| I | 0.43 | 0.21 | 0.55 | 0.046 | 0.05 | 0.003 | 0.0021 | 0.021 | 0.0053 | Ca0.0015 | 0.0003 | 0.0053 | 0.0008 | 0.0147 |
| J | 0.41 | 0.23 | 0.57 | 0.046 | 0.07 | 0.002 | 0.0024 | 0.017 | 0.0009 | — | 0.0003 | 0.0060 | 0.0007 | 0.0119 |
| K | 0.40 | 0.22 | 0.55 | 0.045 | 0.05 | 0.002 | 0.0095 | 0.016 | 0.0011 | — | 0.0011 | 0.0238 | 0.0006 | 0.0112 |
| L | 0.41 | 0.25 | 0.56 | 0.044 | 0.07 | 0.002 | 0.0032 | 0.006 | 0.0048 | — | 0.0004 | 0.0080 | 0.0002 | 0.0042 |
| M | 0.48 | 0.20 | 0.76 | 0.025 | 0.10 | 0.007 | 0.0002 | 0.005 | 0.0017 | — | 0.0000 | 0.0055 | 0.0002 | 0.0035 |

TABLE 2

| No. | Hardness (HV) | Fatigue Strength (MPa) | Pearlite Block (μm) | Number Density (/mm$^2$) | Stand. Dev. | Ave. Mns Length (μm) | (mm) | Machinability |
|---|---|---|---|---|---|---|---|---|
| Invention | | | | | | | | |
| 1 | 258 | 380 | 17.5 | 38.6 | 4.2 | 17.3 | 11.2 | — |
| 2 | 264 | 377 | 21.4 | 39.6 | 4.8 | 18.1 | 11.2 | — |
| 3 | 307 | 406 | 21.8 | 39.0 | 4.6 | 16.4 | 8.8 | — |
| 4 | 270 | 365 | 20.4 | 38.6 | 3.8 | 15.8 | 10.8 | — |
| 5 | 270 | 368 | 20.1 | 40.1 | 2.9 | 18.2 | 10.2 | — |
| 6 | 272 | 880 | 19.9 | 36.8 | 4.1 | 16.5 | 10.3 | 100 |
| 7 | 293 | 413 | 18.7 | 41.8 | 4.6 | 18.4 | 9.0 | — |
| 8 | 274 | 375 | 20.6 | 36.5 | 3.3 | 14.8 | 9.9 | 720 |
| 9 | 276 | 368 | 19.8 | 39.9 | 3.8 | 17.0 | 9.7 | 480 |
| 10 | 258 | 387 | 17.7 | 40.3 | 4.5 | 15.6 | 12.8 | 250 |
| Control | | | | | | | | |
| A | 227 | 315* | 19.6 | 27.1 | 7.1 | 21.9 | 14.3 | — |
| B | 319 | 418 | 25.2 | 26.5 | 8.9 | 22.3 | 6.2* | — |
| C | 322 | 442 | 23.5 | 25.4 | 9.0 | 23.1 | 6.1* | — |
| D | 344 | 428 | 24.5 | 30.1 | 6.8 | 20.4 | 5.3* | — |
| E | 291 | 402 | 23.6 | 29.2 | 7.0 | 19.9 | 7.8* | — |
| F | 284 | 386 | 24.2 | 28.6 | 6.5 | 22.1 | 6.8* | 760 |
| G | 276 | 396 | 23.9 | 29.5 | 7.2 | 23.4 | 7.2* | — |
| H | 280 | 390 | 23.7 | 26.1 | 8.2 | 22.6 | 7.1* | — |
| I | 276 | 396 | 22.2 | 28.0 | 6.6 | 21.3 | 8.2* | 700 |
| J | 285 | 365 | 21.9 | 24.0 | 8.5 | 22.8 | 7.8* | — |
| K | 275 | 392 | 22.6 | 28.0 | 6.2 | 19.2 | 8.1* | — |
| L | 280 | 386 | 23.6 | 31.9 | 4.9 | 18.6 | 7.7* | — |
| M | 270 | 360 | — | — | — | — | 8.6 | — |

Table 2 shows that the steels according to the present invention exhibit hardness HV258–307, fatigue strength 365–413 MPa, size of pearlite blocks 17.5–21.8 μm, number density of MnS-inclusions, which shows distribution of MnS, 38.9–39.6/mm$^2$, standard deviation of the number density of MnS-inclusions 4.2–4.8, averaged length of MnS particles 16.4–18.1 μm and straightening-ability by bending 8.8–12.8 mm. The machinability of the steels of Examples 8–10, which contain Pb, Ca or Bi in addition to S, was 2.5–7.2 times higher than that of Example 6 which contains S only.

Contrary to this, Control A, which contain less amount of C, has hardness of HV 227, and due to the low hardness, the fatigue strength is 315 MPa, much lower than those of the steels of this invention.

On the other hand, Control B, which contains too much C, exhibits too high a hardness of HV 319, and the size of pearlite blocks is so large as 25.2 μm, straightening-ability by bending is such a low value as 6.2 mm.

Controls C and D, which contain too much Mn or Cr, have too high hardness of HV 442 and 428, and too large size of pearlite blocks of 23.5 μm and 24.5 μm. The straightening-abilities by bending of these steels are as low as 6.1 mm and 5.1 mm.

Control E having a large size of pearlite block showed a relatively low straightening-ability by bending of 7.8 mm.

Controls F, G and H containing less amount of Ti, due to the large size of pearlite blocks of 24.2 μm, 23.9 μm and 23.7 μm. showed low straightening-ability by bending of 6.8 mm, 7.2 mm and 7.1 mm.

Control I containing a large amount of O had a relatively large size of pearlite blocks of 22.2 μm, and therefore, the straightening-ability by bending was relatively low value of 8.2 mm.

Control J containing a small amount of O also had a relatively large size of pearlite blocks of 21.9 μm, and the straightening-ability by bending was a relatively low value of 7.8 mm.

In Control K, which does not meet the condition of 0.12[Ti%]<[O%], i.e., the amount of O is too small relative to the amount of Ti, the inclusions were not uniformly distributed, and the straightening-ability by bending was a relatively low value of 8.1 mm.

In Control L, which does not meet the condition of [O%]<0.7[N%], i.e., the amount of O is too much relative to the amount of N, distribution of the inclusions was also not uniform, and the straightening-ability by bending was a relatively low value of 7.7 mm.

In Control M, which does not meet the condition of [O%]<2.5[Ti%], i.e., the amount of O is too much relative to the amount of Ti, the straightening-ability by bending was a relatively low value of 8.6 mm.

In all the Controls the number densities of MnS-inclusions, which are considered to represent uniformity of distribution of MnS, are such value lower than those of the steel of this invention as in the range of 24.0–31.9 particles/$mm^2$. Further, the standard deviations of the number density of MnS are such value as 4.9–9.0, which are larger than those of the present steels. The averaged lengths of MnS-particles are 18.6–23.4 $\mu$m, which are also larger than those of the present invention.

We claim:

1. A non-heat treated steel for soft nitriding consisting essentially of, by weight, C: 0.2–0.6%, Si: 0.05–1.0%, Mn: 0.25–1.0%, S: 0.03–0.2%, Cr: up to 0.2%, sol-Al: up to 0.045%, Ti: 0.002–0.01%, N: 0.005–0.025%, and O: 0.001–0.005%; provided that the conditions, $$0.12[Ti\%]<[O\%]<2.5[Ti\%] \text{ and } 0.04[N\%]<[O\%]<0.75[N\%],$$

are met; the balance being Fe and inevitable impurities; and the structure after hot forging being a mixed structure of ferrite and pearlite.

2. A non-heat treated steel for soft nitriding consisting essentially of, by weight, C: 0.2–0.6%, Si: 0.05–1.0%, Mn: 0.25–1.0%, S: 0.03–0.2%, Cr: up to 0.2%, sol-Al: up to 0.045%, Ti: 0.002–0.01%, N: 0.005–0.025% and O: 0.001–0.005%, and further, one or more of Pb: 0.01–0.40%, Ca: 0.0005–0.0050% and Bi: 0.005–0.40%; provided that the conditions, $$0.12[Ti\%]<[O\%]<2.5[Ti\%] \text{ and } 0.04[N\%]<[O\%]<0.75[N\%],$$

are met; the balance being Fe and inevitable impurities; and the structure after hot forging being a mixed structure of ferrite and pearlite.

* * * * *